United States Patent [19]

Zurkinden

[11] Patent Number: 4,492,728

[45] Date of Patent: Jan. 8, 1985

[54] SPORTS GROUND COVERING WITH EXPANDED CLAY PARTICLES

[76] Inventor: Pierre Zurkinden, Obholzerstrasse 22, Birchwil, Switzerland

[21] Appl. No.: 468,497

[22] Filed: Feb. 22, 1983

[30] Foreign Application Priority Data

Feb. 19, 1982 [WO] PCT Int'l Appl. ..... CH82/00024

[51] Int. Cl.[3] ..... B32B 5/16

[52] U.S. Cl. ..... 428/240; 428/241; 428/247; 428/257; 428/323; 428/325; 428/454; 428/492; 428/493; 428/903.3

[58] Field of Search ..... 428/241, 240, 247, 257, 428/325, 323, 454, 492, 493, 903.3

[56] References Cited

U.S. PATENT DOCUMENTS 4,297,408 10/1981 Stead ..... 428/241

*Primary Examiner*—Marion E. McCamish

*Attorney, Agent, or Firm*—Roylance, Abrams, Berdo & Goodman

[57] ABSTRACT

The covering has a lower or cushioning layer (1) and an upper or wear-resisting coating (2), between which there is a reinforcing iron netting (3). Both the layers contain rubber chips (4), which are produced from old vehicle tires. The lower layer used for cushioning impact effects on the covering, is additionally provided with spherical expanded clay (5), which gives said layer a particular elasticity and also makes it independent of atmospheric humidity during production.

2 Claims, 1 Drawing Figure

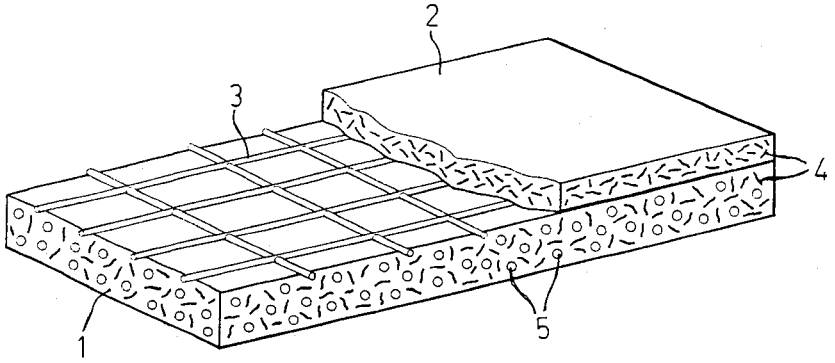
2
3
4
1
5

SPORTS GROUND COVERING WITH EXPANDED CLAY PARTICLES

BACKGROUND OF THE INVENTION

Swiss Pat. No. 601,567 describes a sports ground covering, with a lower layer for cushioning or damping impact actions on the covering and a thinner wear-resisting coating applied thereto. The lower or cushioning layer stabilized by a reinforcing iron netting, according to a preferred embodiment, contains, apart from rubber chips, which emanate from old vehicle tyres and are bound with polyurethane, mineral additives, enabling the elasticity of the layer to be adjusted to a desired value.

Sports ground coverings constructed in this way have excellent characteristics. However, certain problems occur during their production, as a result of the use of mineral additives. Due to the fact that they consist of chippings, concrete rubble and/or sand, they are hygroscopic. The moisture proportion contained therein consequently varies within certain limits. During the production of the cushioning layer in situ, it is therefore largely a question of how and where the mineral additives were stored beforehand. It is quite possible for the moisture content to change during the production of the sports ground covering, because said contents can be lower during the late afternoon than in the morning when starting work. As a result, the properties of the covering change.

In addition, due to their porosity, said additives also partly absorb the binder, i.e. the polyurethane, namely to an extent which is partly dependent on the particle size of the minerals and therefore makes accurate metering of the binder more difficult. Thus, during manufacture, it is necessary to depend on the values obtained through experience, but this can only gradually be acquired. However, sports ground coverings must have the correct composition from the outset. Furthermore, additional problems are caused by the fact that in the case of excessively high moisture contents of the mineral additives, the polyurethane tends to expand.

Thus, the object of the invention is to replace this additive by a more suitable material, thereby not only simplifying production, but also if possible, carrying out part of the production process beforehand, so that in situ it is only necessary to carry out the actual installation.

SUMMARY OF THE INVENTION

A sports ground covering of the aforementioned type and which complies with these requirements, is characterized in that the said additives comprise expanded clay.

In accordance with this invention, a sports ground covering is provided which has a lower or cushioning layer (1) and an upper or wear-resistant coating (2), between which there is a reinforcing iron netting (3). Both the layers contain rubber chips (4). The lower layer used for cushioning impact effects on the covering is additionally provided with expanded clay (5), which gives said layer a particular elasticity and also makes it independent of atmospheric humidity during production.

BRIEF DESCRIPTION OF THE DRAWING

The drawing is a perspective view partially in section of the sports ground covering of this invention.

DETAILED DESCRIPTION OF THE INVENTION

The only drawing shows a perspective view of a sports ground covering having in principle the same construction as the covering according to Swiss Pat. No. 601,567, namely a lower or cushioning layer 1, an upper or wear-resisting coating 2 and intermediately a reinforcing iron netting 3, which stabilizes layer 1. Both layers contain rubber chips 4, which are produced from old vehicle tires and are bound with polyurethane. The complete covering is applied to a not shown gravel layer, which ensures the draining off of rain water or melted snow. Whereas hitherto the cushioning layer 1 contained mineral additives, it is now mixed with expanded clay 5, which is preferably in the form of small balls. This expanded clay has the following advantages.

1. It is not porous and is therefore not hygroscopic. Thus, it always has the same specific gravity, independently of the atmospheric humidity, which exists during the production of the sports ground covering or which existed during the storage of the expanded clay. This constant bulk density leads to a constant quality of the covering. In addition, the hitherto frequently observed expansion of the polyurethane used as a binder for the rubber chips occurring when the water content of the mineral additives is too high is no longer encountered.

Due to the lack of porosity, not only is the absorption of water prevented, but also the absorption of part of the polyurethane. Thus, the latter can be metered in an accurate manner, which contributes to the further uniformity of the covering. In addition, much less polyurethane is required than hitherto.

2. Due to this uniformity, it is not only possible to industrially prepare the actual expanded clay, but also the cushioning layer containing it, so that the latter only has to be laid at the point where it is to be used. Such a prefabrication was admittedly also possible when mineral additives were used, but led to the difficulty that during transportation, part of said additives were separated again from the layer material, particularly due to the unavoidable vibrations. However, the expanded clay balls are completely integrated into the said material.

3. The constant specific gravity of the expanded clay balls also permits uniform production when the ball diameters differ. Thus, there is no dependence of the quality on the particle size, as was encountered in the hitherto used minerals.

4. Expanded clay is more elastic than mineral additives. As a result, not only is the covering made more elastic, but it is also less sensitive to extreme temperature variations.

The aforementioned use of expanded clay makes it possible to obtain a very robust and hard-wearing sports ground covering.

What is claimed is:

1. A sports ground covering comprising a lower layer (1) for cushioning or damping impact effects on the covering, an upper wear-resisting coating (2) applied thereto and an intermediate reinforcing netting (3) for stabilizing the cushioning layer (1), the two layers (1, 2) containing rubber chips (4) bound with polyurethane, said lower layer (1) also containing expanded clay (5) interspersed therein.

2. A sports ground covering as defined in claim 1 wherein said expanded clay is in the form of small balls.

* * * * *